US006308592B1

(12) United States Patent
Turnwald

(10) Patent No.: US 6,308,592 B1
(45) Date of Patent: Oct. 30, 2001

(54) CORKSCREW

(76) Inventor: Hans A. Turnwald, 2893 SW. 69th Ct., Miami, FL (US) 33155

( * ) Notice: Subject to any disclaimer, the term of this patent is extended or adjusted under 35 U.S.C. 154(b) by 0 days.

(21) Appl. No.: 09/885,559

(22) Filed: Jun. 20, 2001

(51) Int. Cl.[7] ..... B67B 7/18
(52) U.S. Cl. ..... 81/3.29; 81/3.45
(58) Field of Search ..... 81/3.07, 3.36, 81/3.29, 3.45

(56) References Cited

U.S. PATENT DOCUMENTS

| | | | | |
|---|---|---|---|---|
| 2,305,532 | | 12/1942 | Jackson . | |
| 2,522,219 | | 9/1950 | Gaeta . | |
| 4,253,351 | * | 3/1981 | Allen | 81/3.29 |
| 4,276,789 | | 7/1981 | Allen . | |
| 4,377,096 | | 3/1983 | Allen . | |
| 4,703,673 | * | 11/1987 | Allen | 81/3.29 |
| 5,503,047 | * | 4/1996 | Brockington | 81/3.29 |

* cited by examiner

*Primary Examiner*—Eileen P. Morgan
*Assistant Examiner*—Joni B. Danganan
(74) *Attorney, Agent, or Firm*—Ruben Alcoba

(57) ABSTRACT

A force minimizing corkscrew which comprises a guiding holder, a cork engaging means which is inserted into said guiding holder, and a force generating member which is attached to said cork engaging means, after first placing upper and lower bearings between the elements.

20 Claims, 2 Drawing Sheets

CORKSCREW

BACKGROUND

Figure 1:
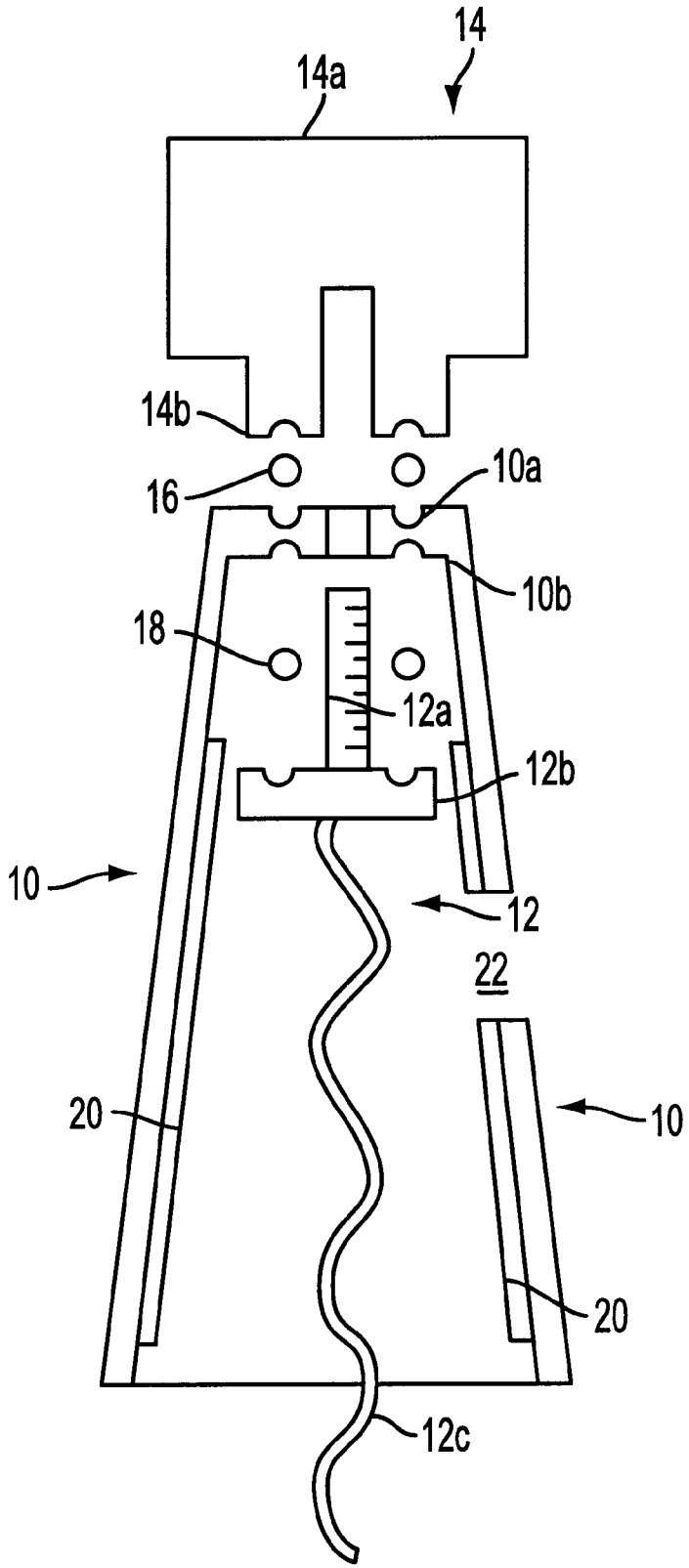

The present invention relates to a force minimizing corkscrew that reduces the amount of force needed to open corked bottles.

In the sparkling wine and gaseous beverage field there is a need for a force minimizing corkscrew that reduces the amount of force needed to open corked bottles.

In the past, various type of cork removers have been introduced. The devices can be classified into two general groups. The first group are devices that require a users physical force to remove the cork from a bottle and the second group are devices that insert gas inside a bottle so that the cork is expelled due to pressure created within the bottle.

Two immediate problems that may arise with these devices are as follows: (1) the first type of devices prevent users that do not have the physical strength to open corked bottles, and (2) the second types of devices can be dangerous to the general public if misused.

Information relevant to attempts to address these problems can be found in U.S. Pat. Nos. 5,010,790, 4,377,096, 4,572,034, 2,522,219, 2,305,532, 396,286, and 382,005. However, each one of theses references suffers from one or more of the above disadvantages.

For the foregoing reasons, there is a need for a force minimizing corkscrew that requires a minimal amount of force to operate.

SUMMARY

The present invention is directed to an easily removable corkscrew that satisfies the following needs: the need to remove a cork from a bottle using a minimal amount of force, and the need to prevent accidents that may occur using cork removers that use gaseous pressure to remove corks. A force minimizing corkscrew having features of the present invention comprises a guiding holder having an upper and a lower side; a cork engaging means which comprises of a top, a middle, and a bottom part, wherein the top of said cork engaging means is inserted through said guiding holder; a force generating member, that has an upper and a lower side, that is attached to said top of said cork engaging means after the cork engaging member has been inserted through said guiding holder; and upper and lower bearings, wherein said upper bearings are placed between said lower part of said force generating member and said upper side of said guiding holder, and said lower bearings are placed between said lower side of said guiding holder and said middle part of said cork engaging means. The following parts are grooved and said grooves are circular so that when said upper and lower bearings are placed within said grooves and the force generating member is turned in either a clockwise or counterclockwise direction, the manual force required to remove a cork from a corked bottle will be minimized: said lower side of said force generating member, said upper side of said guiding holder, said lower side of said guiding holder, and said middle part of said cork engaging means. Furthermore, said lower part of said cork engaging means, after the force minimizing corkscrew has been assembled, will extend past the guiding holder so that the lower part of said cork engaging means can be screwed into the cork up until said guiding holder is flush with the lip of a corked bottle, once the lip of the corked bottle and said guiding holder are flush, the cork will internally be spiraled upward by said lower part of said cork engaging means until the cork is within said guiding holder. Said guiding holder may contain at least two friction means running parallel to said cork engaging means and said friction means being attached to said guiding holder.

An advantage of this invention is that it allows corked bottles to be opened using a minimal amount of force.

Another advantage of the invention is that the force minimizing corkscrew prevents accidents that may occur using pressure bottle openers.

DRAWING

Figure 2:
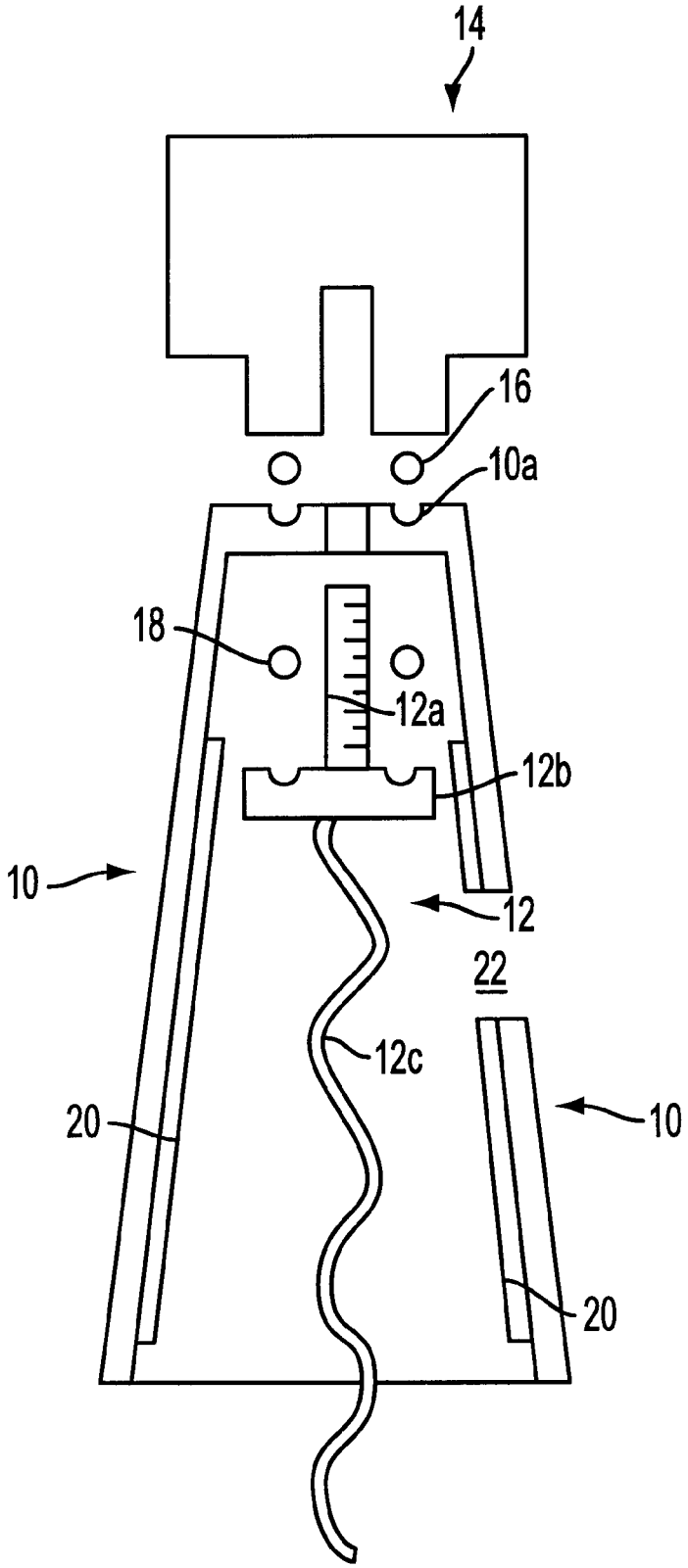

These and other features, aspects, and advantages of the present invention will become better understood with regard to the following description, appended claims, and accompanying drawings where:

FIG. 1 of the drawing shows a full sectional view of one embodiment of the invention, and FIG. 2 of the drawing shows a full sectional view of another embodiment of the present invention.

DESCRIPTION

In order to be better understood, a description of the invention is herewith offered, based on a practical application of the above mentioned drawings.

As shown in FIG. 1, a force minimizing corkscrew comprises a guiding holder 10, having an upper 10*a,* and a lower side 10*b;* a cork engaging means 12, which comprises of a top 12*a,* a middle 12*b,* and a bottom part 12*c,* wherein the top 12*a* of said cork engaging means 12 is inserted through said guiding holder 10; a force generating member 14, that has an upper 14*a,* and a lower side 14*b,* that is attached to said top of said cork engaging means 12*a,* after the cork engaging means 12 has been inserted through said guiding holder 10; and upper 16 and lower 18 bearings, wherein said upper bearings 16 are placed between said lower part of said force generating member 14*b* and said upper side of said guiding holder 10*a,* and said lower bearings 18 are placed between said lowers side of said guiding holder 10*b* and said middle part of said cork engaging means 12*b.* The following parts are grooved and said grooves are circular so that when said upper and lower bearings are placed within said grooves and the force generating member is turned in either a clockwise or counterclockwise direction, the manual force required to remove a cork from a corked bottle will be minimized: said lower side of said force generating member 14*b,* said upper side of said guiding holder 10*a,* said lower side of said guiding holder 10*b,* and said middle part of said cork engaging means 12*b.* Furthermore, said lower part of said cork engaging means 12*c,* after the force minimizing corkscrew has been assembled, must extend past the guiding holder 10 so that the lower part of said cork engaging means 12*c* can be screwed into the cork up until said guiding holder 10 is flush with a lip of a corked bottle, once said lip of said corked bottle and said guiding holder 10 are flush, the cork will internally be spiraled upward by said lower part of said cork engaging means 12*c* until the cork is within said guiding holder 10. Said guiding holder 10 may contain at least two friction means 20 running parallel to said cork engaging means 12, and said friction means 20 being attached to said guiding holder 10. In addition, said guiding holder 10 may define a window 22 that runs parallel to said cork engagement means 12 so that a user may see if the corkscrew is being forced up the guiding holder 10. Another use for said window 22 is to allow for manual pressure to be applied to said cork when said force generating member 14 is turned in an opposite direction than was originally applied to remove the cork from the corked bottle.

The force minimizing corkscrew may use either ball, conical, or prism bearings. The lower part of said cork engagement means may be a helix screw. The upper part of said cork engagement means can be attached to said force generating member by any means known in the art.

In another embodiment of the invention, as seen in FIG. 2, said upper side of said guiding holder 10*a* and said middle part of said cork engaging means 12*b* are grooved and said grooves are circular so that when said upper and lower bearings are placed within said grooves, and said guiding holder, said cork engagement means, said force generating member, and said upper and lower bearings are assembled together, said upper and lower bearings will be held in place within said force minimizing corkscrew.

An advantage of this invention is that it allows corked bottles to be opened using a minimal amount of force.

Another advantage of the invention is that this force minimizing corkscrew prevents accidents that may occur using pressure bottle openers.

What is claimed is:

1. A force minimizing corkscrew comprising:

a guiding holder having an upper and a lower side;

a cork engaging means which comprises of a top, a middle, and a bottom part, wherein the top of said cork engaging member is inserted through said guiding holder;

a force generating member, that has an upper and a lower side, that is attached to said top of said cork engaging member after the cork engaging means has been inserted through said guiding holder; and upper and lower bearings, wherein said upper bearings are placed between said lower part of said force generating member and said upper side of said guiding holder, and said lower bearings are placed between said lower side of said guiding holder and said middle part of said cork engaging means.

2. The force minimizing corkscrew of claim 1, wherein said lower side of said force generating member, said upper side of said guiding holder, said lower side of said guiding holder, and said middle part of said cork engaging means are grooved and said grooves are circular so that when said upper and lower bearings are placed within said grooves and the force generating member is turned in either a clockwise or counterclockwise direction, the manual force required to remove a cork from a corked bottle will be minimized.

3. The force minimizing corkscrew of claim 2, wherein said lower part of said cork engaging means, after the force minimizing corkscrew has been assembled, will extend past the guiding holder so that the lower part of said cork engaging means can be screwed into the cork up until said guiding holder is flush with a lip of a corked bottle, once said lip of said corked bottle and said guiding holder are flush, said cork will internally be spiraled upward by said lower part of said cork engaging means until the cork is within said guiding holder.

4. The force minimizing corkscrew of claim 3, further comprising at least two friction means running parallel to said cork engaging means and said friction means being attached to said guiding holder.

5. The force minimizing corkscrew of claim 4, wherein said guiding holder defines a window that runs parallel to said cork engagement means.

6. The force minimizing corkscrew of claim 1, wherein said lower part of said cork engaging means, after the force minimizing corkscrew has been assembled, will extend past the guiding holder so that the lower part of said cork engaging means can be screwed into the cork up until said guiding holder is flush with a lip of a corked bottle, once said lip of said corked bottle and said guiding holder are flush, said cork will internally be spiraled upward by said lower part of said cork engaging means until said cork is within said guiding holder.

7. The force minimizing corkscrew of claim 6, wherein said lower side of said force generating member, said upper side of said guiding holder, said lower side of said guiding holder, and said middle part of said cork engaging means are grooved and said grooves are circular so that when said upper and lower bearings are placed within said grooves and the force generating member is turned in either a clockwise or counterclockwise direction, the manual force required to remove a cork from a corked bottle will be minimized.

8. The force minimizing corkscrew of claim 7, further comprising at least two friction means running parallel to said cork engaging means and said friction means being attached to said guiding holder.

9. The force minimizing corkscrew of claim 8, wherein said guiding holder defines a window that runs parallel to said cork engagement means.

10. The force minimizing corkscrew of claim 1, wherein said upper side of said guiding holder and said middle part of said cork engaging means are grooved and said grooves are circular so that when said upper and lower bearings are placed within said grooves, and the force generating member is turned in either a clockwise or counterclockwise direction, the manual force required to remove a cork from a corked bottle will be minimized.

11. The force minimizing corkscrew of claim 10, wherein said lower part of said cork engaging means, after the force minimizing corkscrew has been assembled, will extend past the guiding holder so that the lower part of said cork engaging means can be screwed into the cork up until said guiding holder is flush with a lip of a corked bottle, once said lip of said corked bottle and said guiding holder are flush, said cork will internally be spiraled upward by said lower part of said cork engaging means until the cork is within said guiding holder.

12. The force minimizing corkscrew of claim 11, further comprising at least two friction means running parallel to said cork engaging means and said friction means being attached to said guiding holder.

13. The force minimizing corkscrew of claim 12, wherein said guiding holder defines a window that runs parallel to said cork engagement means.

14. The force minimizing corkscrew of claim 1, wherein said lower part of said cork engaging means is a helix screw that extends past said guiding holder.

15. The force minimizing corkscrew of claim 14, wherein said upper side of said guiding holder and said middle part of said cork engaging means are grooved and said grooves are circular so that when said upper and lower bearings are placed within said grooves, and the force generating member is turned in either a clockwise or counterclockwise direction, the manual force required to remove a cork from a corked bottle will be minimized.

16. The force minimizing corkscrew of claim 15, further comprising at least two friction means running parallel to said cork engaging means and said friction means being attached to said guiding holder.

17. The force minimizing corkscrew of claim 16, wherein said guiding holder defines a window that runs parallel to said cork engagement means.

18. The force minimizing corkscrew of claim 14, wherein said lower side of said force generating member, said upper side of said guiding holder, said lower side of said guiding holder, and said middle part of said cork engaging means are grooved and said grooves are circular so that when said upper and lower bearings are placed within said grooves and the force generating member is turned in either a clockwise or counterclockwise direction, the manual force required to remove a cork from a corked bottle will be minimized.

19. The force minimizing corkscrew of claim 18, further comprising at least two friction means running parallel to said cork engaging means and said friction means being attached to said guiding holder.

20. The force minimizing corkscrew of claim 19, wherein said guiding holder defines a window that runs parallel to said cork engagement means.

* * * * *